United States Patent [19]

Kelley

[11] 4,067,631

[45] Jan. 10, 1978

[54] UNDER WORK SURFACE ORGANIZER

[75] Inventor: James O. Kelley, Spring Lake, Mich.

[73] Assignee: Herman Miller, Inc., Zeeland, Mich.

[21] Appl. No.: 705,822

[22] Filed: July 16, 1976

[51] Int. Cl.[2] ..... A47B 97/00

[52] U.S. Cl. ..... 312/322; 312/201; 312/326

[58] Field of Search ..... 312/326, 201, 322, 198

[56] References Cited

U.S. PATENT DOCUMENTS

| | | | |
|---|---|---|---|
| 344,132 | 6/1886 | Palmer | 312/201 |
| 2,501,404 | 3/1950 | Muller | 312/322 |
| 2,525,975 | 10/1950 | Thomas et al. | 312/322 |

FOREIGN PATENT DOCUMENTS

| | | | |
|---|---|---|---|
| 2,209,386 | 2/1972 | Germany | 312/326 R |

*Primary Examiner*—Robert L. Wolfe
*Assistant Examiner*—Alexander Grosz
*Attorney, Agent, or Firm*—Price, Heneveld, Huizenga & Cooper

[57] ABSTRACT

An organizing system is disclosed which is mountable under a horizontally positioned work surface such as a desk top. The organizing system includes a pair of generally rectangular frames hingedly connected to the vertical side support members of the desk top. Various storage modules are supported by a housing arrangement slidably positioned on the hinged frame. The arrangement is pivotable to a closed position underneath the work surface which permits unrestricted lateral movement of the user. When the hinged frames are pivoted outwardly and the housings are fully extended, the storage modules are readily available for use.

28 Claims, 13 Drawing Figures

UNDER WORK SURFACE ORGANIZER

BACKGROUND OF THE INVENTION

This invention relates to article storage structures and more particularly to a unique storage and organizing system mountable under a work surface such as a desk top or the like.

Conventional desk structures generally include a desk top supported by depending drawer and leg structures. The drawers dominate and restrict the knee clearance space beneath the desk top and also restrict lateral movement of the desk user. Also, since the drawer cabinet structures are fixedly positioned with respect to the work surface, access to the contents of the drawers is awkward and in some cases severely restricted.

Also, furniture constructions have been proposed which employ a plurality of vertically diposed space divider panels rigidly secured together by connector post structures. An example of such furniture constructions may be found in U.S. Pat. No. 3,674,230 to Probst, entitled FURNITURE CONSTRUCTION, issued July 4, 1972. As disclosed therein, these furniture structures are relocatable so as to provide the most efficient use of available office or other space. Provision is made for hanging cabinets, desks, and other structures from the relocatable wall arrangement. For example, a cantilever desk including a desk top or work surface is hangable from the connector post structures by a bracket and clip arrangement. Presently, however, storage and organizing arrangements are not available for use with either more conventional desk structures or cantilevered desks of the type disclosed in the aforementioned patent which result in unobstructed knee clearance, do not inhibit nor restrict lateral movement beneath the work surface and which, when open, provide ready, unrestricted access for storage and retrieval of various items.

SUMMARY OF THE INVENTION

In accordance with the present invention, a unique under work surface organizing system is provided which results in unobstructed knee clearance, permits unrestricted lateral movement and provides easy access for storage and retrieval of items when in an open position. Essentially, the under work surface organizing system includes a generally rectangular frame hingedly connected to a vertical side support member of the work surface or desk top. Provision is made for securing a storage module to the hinged frame so that the storage module may be pivoted outwardly and slideably extended to permit unrestricted access for storage and retrieval purposes.

DETAILED DESCRIPTION OF THE PREFERRED EMBODIMENT

Figure 1:
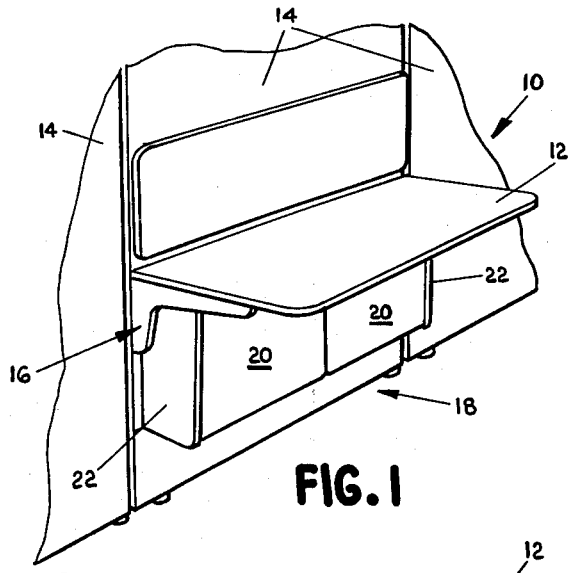
FIG. 1 is a perspective view of a cantilevered desk structure including an under work surface organizing system in accordance with the present invention.
Figure 2:
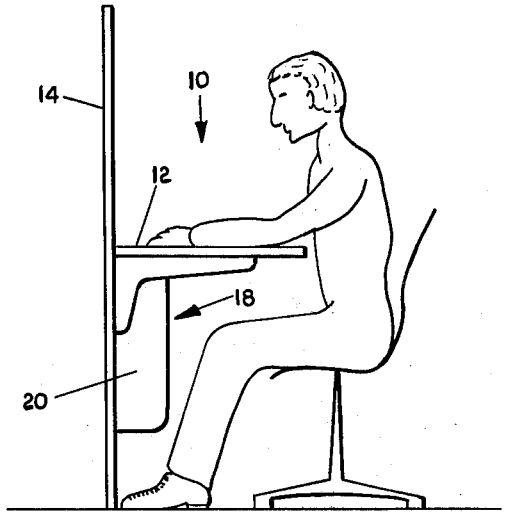
FIG. 2 is a side elevational view of the arrangement of FIG. 1.

A typical desk arrangement incorporating the under work surface organizer in accordance with the present invention is illustrated in FIGS. 1 and 2 and generally designated 10. The desk structure 10 includes a cantilevered desk top or work surface 12 supported from a relocatable wall arrangement. The wall includes a plurality of space divider components 14. The space dividers 14 are rigidly interconnected by connector post structures and the desk top 12 is hung from the connector post by a bracket and clip arrangement 16. This general structural arrangement, which forms no part of the present invention, is more fully described in the aforementioned, commonly owned U.S. Pat. No. 3,674,230.

Figure 13:
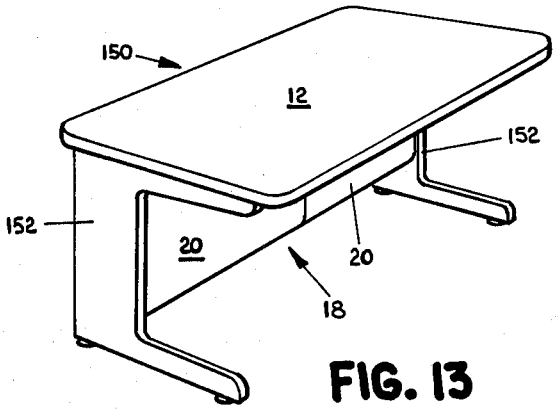
FIG. 13 is a perspective view of a free-standing desk including an under work surface organizing system in accordance with the present invention.

The under work surface organizing system in accordance with the present invention is mounted beneath the desk top 12 and is generally designated 18. The system includes a pair of assemblies 20 hingedly connected to side support plates 22. When employed with the desk structure of the type illustrated in FIGS. 1 and 2, the side support plates may be formed integral with the hanging bracket 16 or, in the alternative, they may be formed as separate members and subsequently secured to either the brackets or the work surface 12. With more conventional desk structures 150, as shown in FIG. 13, the side support plates 22 could take the form of depending leg structures or support members 152 fixedly secured to the under surface of the desk top. The primary consideration is that structure is provided from which the system in accordance with the present invention may be hingedly mounted in a manner spaced from the rear vertical plane of the desk or from the vertical wall structure 14.

Figure 3:
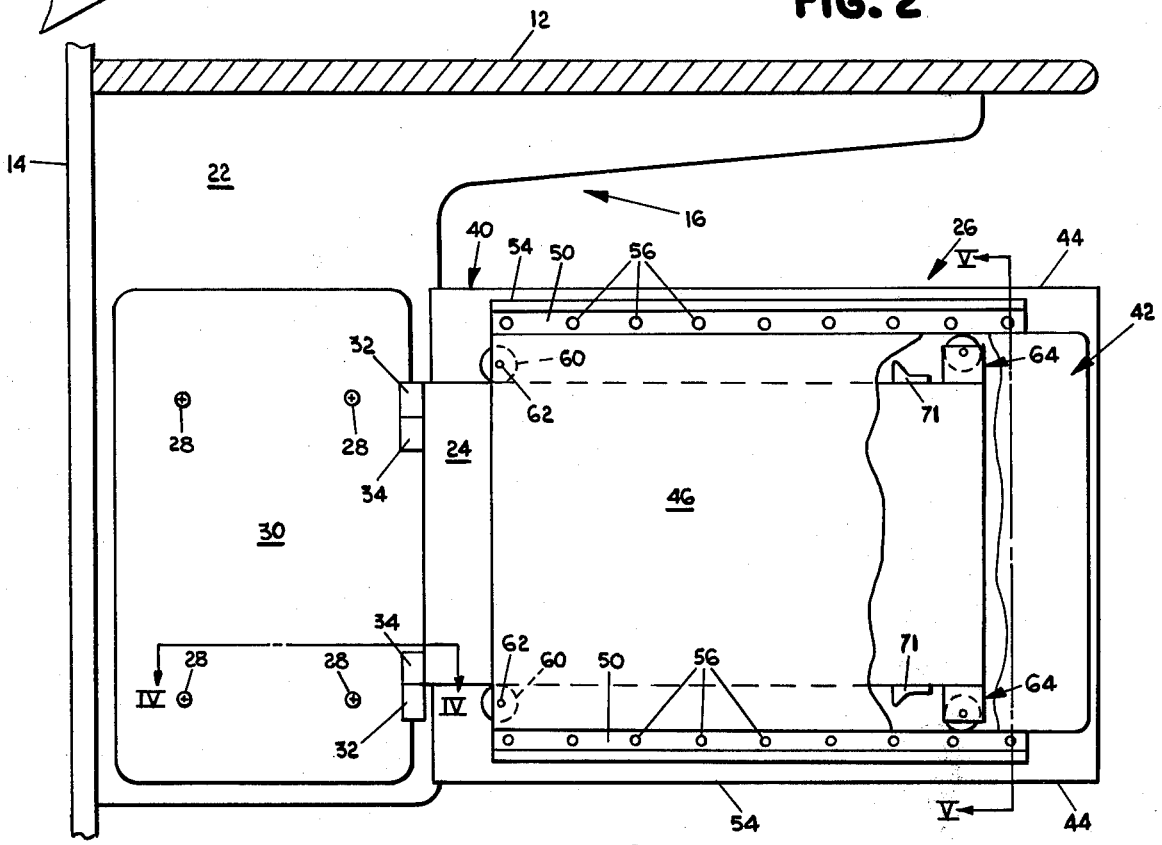
FIG. 3 is a cross-sectional, side elevational view showing a portion of the system in the extended open position.

As best seen in FIG 3, each assembly 20 includes an extension frame or guide member 24 hingedly connected to the vertical support member 22 and an extension assembly or housing arrangement 25 telescopically received on the hinged frame 24. As will be more fully described below, variously configured storage modules are detachably receivable on the extension assembly 26 to thereby increase the versatility of the system.

Figure 4:
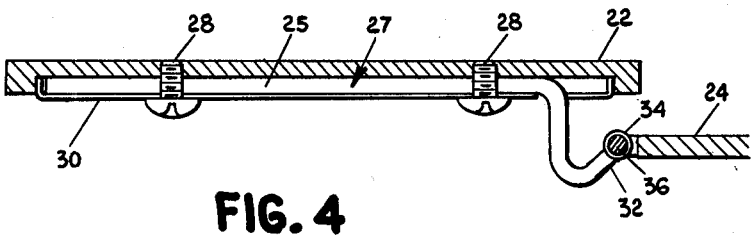
FIG. 4 is a cross-sectional view taken generally along line IV—IV of FIG. 3.

The hinged frame or guide member 24 has a generally rectangular shape and may take the form of a frame type member covered on both sides for aesthetic reasons and having a hollow interior. In the alternative, the frame may be a single, one piece member. The hinged frame 24 is connected to the vertical support plate 22 by a pair of vertically spaced hinge plates 27. As best seen in FIGS. 3 and 4, a recess may be formed in the inwardly directed face of the support plate 22. The hinge plates 27 may be connected or secured to the support plate 22 by suitable fasteners 28 which pass through apertures formed in a cover plate 30. When assembled, the cover plate effectively conceals the vertically spaced hinge plates 27.

Each hinge plate 27 includes an elongated portion 25 which terminates in an outwardly directed cylindrical knuckle portion 32. Formed integral with or otherwise suitably secured to the hinged frame 24 are a pair of vertically spaced, corresponding hinge knuckles 34. Hinge pins 36 extending down through the hinge knuckles 34 pivotably secure the frame 24 to the hinge plate 27 at the knuckles 32. This arrangement permits pivotable movement of the hinged frames 24 towards each other to a closed position in the same vertical plane as well as outward pivotable movement through an angle greater than 90° to an open position.

Figure 5:
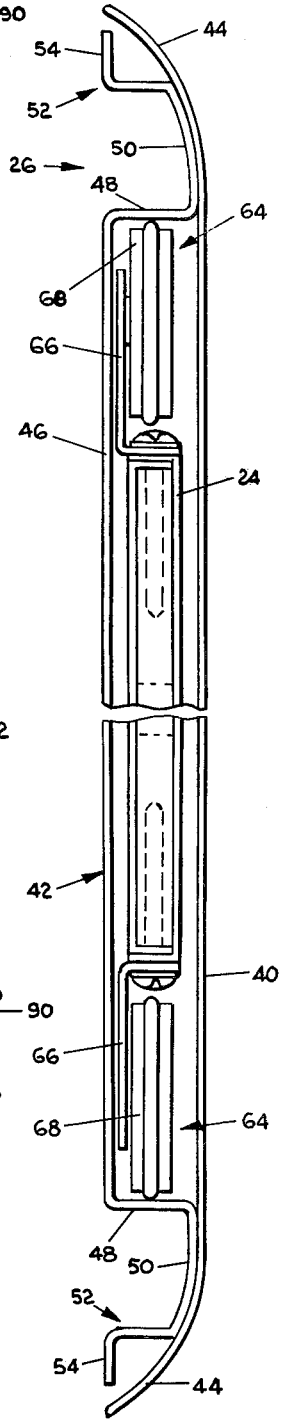
FIG. 5 is a cross-sectional view taken generally along line V—V of FIG. 3.

The details of the module extension and support assemblies 26 are best seen in FIGS. 3 and 5. As shown therein, each assembly 26 includes an outer panel 40 and an inner panel 42. The outer panel 40 has a generally rectangular or planar shape and is curved inwardly along its lateral edges 44 for reasons which will readily become apparent. The inner panel 42 has a generally channeled shape and includes a planar portion 46 and inwardly directed, generally horizontal side portions 48 formed integral with the planar portion. Formed integral with the side portions 48 are vertically positioned attachment strips 50. Formed integral with the attachment strips 50 are outwardly extending, generally L-shaped portions 52. Portions 52 each include a vertical support lip 54. As will be more fully described below, support lips 54 and edges 44 slidably receive and retain the variously configured storage modules.

The inner panel 42 is secured to the inner face of the outer panel 40 by longitudinal spaced fasteners 56 extending through these members at the attachment strip 50. Once secured, the inner and outer panels define a housing for telescopically receiving the hinged frame 24. As a result, the assembly 26 is extendable and retractable on the hinge frame member 24. The panels in effect define a telescoping housing having inner and outer walls and an open end.

In order to provide stability and smoothness of operation, a roller type glide arrangement is incorporated in the extension assembly. As is best seen in FIG. 3, the roller glide arrangment includes a pair of vertically spaced rollers or pulley-like elements 60 rotatably supported by pins 62 extending between the inner cover 42 and the outer cover 40. The roller elements 60 are positioned adjacent the trailing or rearward end of the inner cover or plate 42 and each engages the lateral edge or longitudinally extending surface of the hinged frame 24.

A pair of vertically spaced roller guides 64 are secured at diametrically opposed points to the hinged frame 24 adjacent the free end thereof. The roller guides 64 each include a bracket 66 having a general L-shape (FIG. 8) secured by a means of a suitable fastener to the lateral edge of the hinged frame. Rotatably supported on the bracket 66 is a pulley type roller element 68. The pulley elements 68 ride on and contact the inner peripheral surfaces of the side portions 48 of the inner plate 42. In effect, the glide rollers 60 contact and capture the hinge frame 24 while the guide rollers 66 secured to the end frame contact and capture the assembly 26. As a result, the assembly is prevented from rotating about a horizontal axis.

Figure 8:
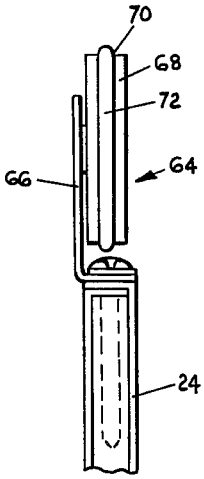
FIG. 8 is an enlarged, fragmentary view showing a portion of the glide structure of the system.

As best seen in FIG. 8, the guide pulley elements 66 include a groove 70 extending continuously around the peripheral surface of the element. As elastomeric ring-like element 72, which may take the form of the conventional O-ring, is positioned within the groove 70. The glide elements 60 are similarly configured and likewise include a circumferential groove with in which is disposed an elastomeric ring. The elastomeric rings which may be formed of rubber or other suitably resilient material contact the surface upon which the pulley element rides. This arrangement reduces the noise which would be present during extension or retraction of the assembly 26. Also, the elastomeric rings function as shock absorbers to isolate the assembly 26 from the frame member 24. The overall arrangement permits smooth, non-binding extension and retraction of each assembly 26 on each hinged frame 24.

The side portions 48 of the inner plate 44 have a transverse dimension which is slightly greater than the thickness of the frame member 24. As a result, the structure is vertically stable and rolling action about the longitudinal axis of the assembly 26 is prevented.

In order to limit extension of each assembly 25 on the guide members 24 and prevent disengagement of the members, stop elements 71 are fixedly mounted at diametrically opposed points to frame 24. The stop elements 71 are positioned intermediate glide roller assemblies 64 and the hinged end of the frame. Preferably, they are secured adjacent the guide rollers, as shown in FIG. 3, to permit maximum extension of the storage modules.

Figure 6:
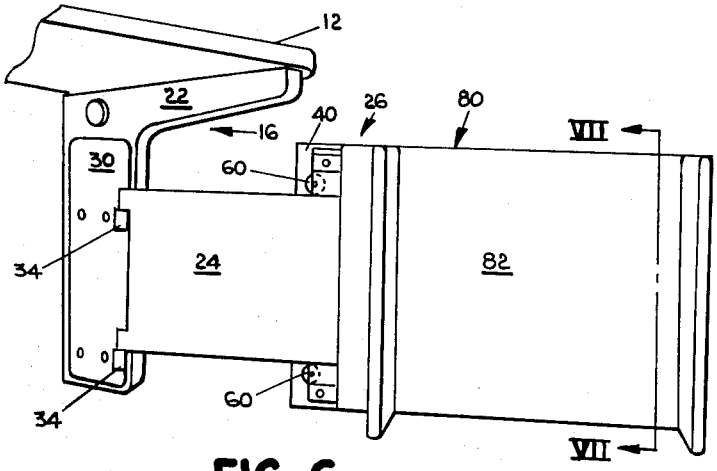
FIG. 6 is a fragmentary, perspective view showing the system with a storage module partially secured thereto.
Figure 7:
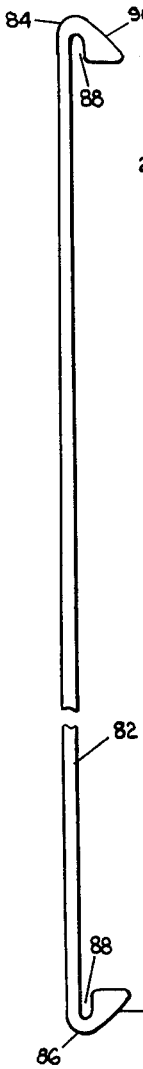
FIG. 7 is a cross-sectional view taken generally along line VII—VII of FIG. 6.

As best seen in FIGS. 6 and 7, the vertically extending lip portions 54 and the inwardly curved portions 44 of the outer panel 40 cooperate to detachably receive and support a storage module 80. As will be discussed in connection with FIGS. 9–12, the storage module 80 may be formed in a variety of configurations depending upon the particular item or items to be stored. Regardless of the specific use for the module, it should include a rear vertical wall 82. As seen in FIG. 7, the vertical wall 82 includes along the lateral edges thereof opposed flange structures 84, 86. The flange structures define facing grooves 88. The outer peripheral surfaces 90 of the flanges 84 have a radius of curvature conforming to the radius of curvature of the lateral edges 44 of the outer panel 40. The vertical spacing between the opposed grooves 88 and the configuration of the flanges 84 is such that each module 80 may be telescopically received or slideably positioned on the vertical lip portions 54 of the inner panel 42. This is best seen in FIG. 6 where the module 80 is partially assembled on the extension and support assembly 26. The flanges 84, 86, the outer panel 40, and inner panel 42 are all dimensioned so that a press fit is obtained when the module 80 is slipped onto the assembly. This press fit increases the frictional contact between the flange 84, 86, the lip portions 54 and the edge portions 44 so that the module will be securely retained on the extension assembly.

As should now be readily apparent, the units 20 are assembled by first centering the frame 24 on the outer panel 44 with the guide roller assemblies already mounted. Next, the glide rollers are positioned on their axle pins 62 and the inner panel is placed over the frame. Suitable fasteners are then employed to secure the panels together. Next the hinge plate assemblies are secured to the spaced side support plates and the hinge pins are slipped within the knuckles to complete the connection. The support plates must be spaced a sufficient distance to permit closing of the system with the assemblies opposing each other in the same vertical plane. Finally, the storage modules are slipped onto the lip portions of the inner panel. In use, the units are readily swingable outwardly with the modules fully extended. A large access and retrieval zone is then presented to the desk user. When closed, as seen in FIG. 2, unrestricted knee clearance and uninhibited lateral movement is provided.

Figure 9:
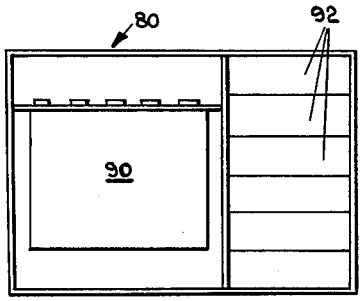

As seen best in FIGS. 9–12, the module 80 may take a variety of arms depending upon the specific storage needs involved. For example, the storage module of FIG. 9 is arranged to support a plurality of hanging folders 90 and includes a plurality of vertically stacked trays 92 for supporting letterhead, for example.

Figure 10:
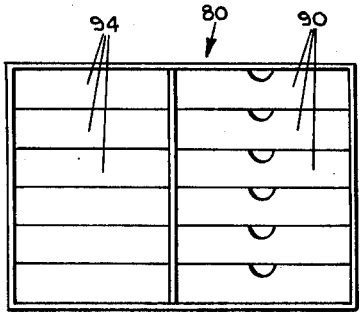

The module illustrated in FIG. 10 includes a plurality of vertically stacked trays or shelves 94 and a plurality of vertically stacked bins or drawers 96. This form of the module is primarily adapted for dispensing and organizing stationery.

Figure 11:
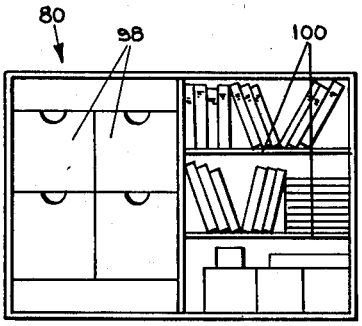
FIGS. 9–12 are front, elevational view of variously configured storage modules.
Figure 12:
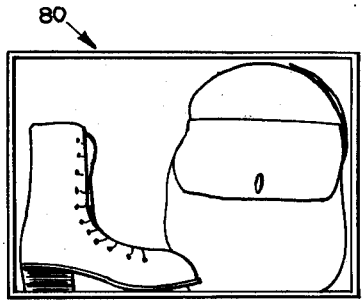

The module illustrated in FIG. 11 includes a plurality of drawers 98 and shelves 100. This module is primarily adapted for storage of small items such as magnetic cards, tape decks, cassettes, etc. The module illustrated in FIG. 12 is a box-like structure and is primarily adapted for the storage of shoes, boots, purses and other bulk items.

Each of the module structures illustrated is preferably formed from a moldable, high impact plastic material. The molding operation lends itself to the production of properly configured attachment flanges 84 and 86. The extension and support assembly 26 is easily manufactured from sheet metal by conventional stamping operations.

As is now readily apparent, the under work surface organizer system in accordance with the present invention provides a unique, easily and relatively inexpensively manufactured and versatile solution to a wide variety of storage problems. Although having primary utility in the area of office organization, the present invention has great use in the storage of articles in the home or workshop environment. The structure is stable and readily adaptable to mounting on any vertical support surface. When employed as an under work surface organizer, the arrangement, as best seen in FIG. 2, provides unrestricted knee clearance for a user and permits uninhibited lateral movement in the work area. When the hinged frames are pivoted outwardly and the assemblies are fully extended, the items stored in each module are presented for easy access by the user. It is expressly intended that the above description be considered as that of the preferred embodiment only. The true spirit and scope of the present invention will be determined by reference to the appended claims.

The embodiments of the invention in which an exclusive property or privilege is claimed are defined as follows:

1. An organizer system adapted for use with a work surface having a vertical support member and said system being supported from said vertical support member, said system being pivotable and extensible from a closed position to an open, storage and retrieval position and comprising:

an elongated frame positioned in a vertical plane and adapted to be hingedly connected at one end to the vertical support member to thereby pivot about a vertical axis;

a storage module; and means telescopingly positioned on said frame and attached to said storage module for permitting extension and retraction of said module on said frame away from and towards said hinged end of said frame.

2. An organizer system as defined by claim 1 wherein said means comprises:

a housing having spaced inner and outer walls and an open end, said housing being received on said hinged frame with said hinged frame extending into said housing at said open end; and means, a part of said inner wall of said housing, for detachably supporting said storage module.

3. An organizer system as defined by claim 2 further including a pair of vertically spaced roller glides rotatably mounted within said housing adjacent the open end thereof, said roller glides positioned to contact the lateral edges of said hinged frame.

4. An organizer system an defined by claim 3 further including a first roller guide mounted on the upper lateral edge of said hinged frame adjacent the free end thereof and a second roller guide mounted on the lower lateral edge of said hinged frame adjacent the free end thereof, said roller guides each positioned to contact and ride on the inner peripheral surface of said housing.

5. An organizer system as defined by claim 4 further including stop means secured to said frame along a lateral edge thereof positioned to contact one of said roller glides and thereby limit extension of said housing relative to said frame.

6. An organizer system as defined by claim 5 wherein each of said roller glides and said roller guides comprises:

a pulley having a continuous groove extending around the outer peripheral surface thereof; and an elastomeric ring positioned on said pulley within said continuous groove, said ring dimensioned so as to contact the surface upon which each pulley rides.

7. An organizer system as deifned by claim 2 wherein said housing comprises:

an outer panel defining said outer wall; and an inner panel secured to said outer panel, said inner panel having a generally channel shape including a main vertical planar portion defining said inner wall, inwardly directed, generally horizontal side portions integral with said planar portion; and wherein said detachable supporting means includes vertical lip portions extending along the lateral edges of said inner panel integral with said side portions.

8. An organizer system as defined by claim 7 wherein said storage module has outwardly directed flanges extending along the lateral edges thereof and defining vertically spaced, longitudinally extending grooves, said lip portions of said inner panel being slidably received within said grooves.

9. An organizer system as defined by claim 6 wherein said housing comprises:

an outer panel defining said outer wall; and an inner panel secured to said outer panel, said inner panel having a generally channel shape including a main vertical planar portion defining said inner wall, inwardly directed, generally horizontal side portions integral with said planar portion; and wherein said detachable supporting means includes vertical lip portions extending along the lateral edges of said inner panel integral with said side portions.

10. An organizer system as defined by claim 9 wherein said storage module has lateral edges defining vertically spaced, longitudinally extending grooves, said lip portions of said inner panel being slidably received within said grooves.

11. An organizer system as defined by claim 1 wherein said work surface includes a second vertical support member, said organizer system further including a second elongated frame adapted to be hingedly connected to said second vertical support member;

another storage module; and means secured to said another storage module and said second frame for permitting sliding extension and retraction of said another storage module on said second elongated frame.

12. An organizer system as defined by claim 10 wherein said work surface includes a second vertical support member, said organizer system further including a second elongated frame adapted to be hingedly connected to said second vertical side support member of a work surface;

another storage module; and means secured to said another storage module and said second frame for permitting sliding extension and retraction of said another storage module on said second elongated frame.

13. An organizing system for use with a structure having a pair of spaced, vertical support members, comprising:

a first hinge plate having a knuckle portion and an elongated portion, said elongated portion adapted to be secured to one of said support members;

a second hinge plate having a knuckle portion and an elongated portion; said elongated portion of said second hinge plate adapted to be secured to the other of said support members;

a first elongated guide member, said first guide member including a knuckle portion adjacent one end thereof;

a second elongated guide member, said second guide member including a knuckle portion adjacent one end thereof;

a pair of hinge pins, one pin being inserted through the knuckle of said first hinge plate and the knuckle of said first guide member, the other pin being inserted through the knuckle of said second hinge plate and the knuckle of said second guide member whereby said guide members are pivotable from a closed position in a plane perpendicular to said support members to an open position through an angle at least equal to 90°;

a first storage module;

first means received on said first guide member for supporting said first storage module for sliding extension and retraction;

a second storage module; and second means received on said second guide member for supporting said second storage module for sliding extension and retraction.

14. An organizing system as defined by claim 13 wherein said first means and said second means each comprises:

a generally rectangular housing having at least one open end and defining a guide member receiving chamber, said housing being slidably positioned on said guide member.

15. An organizing system as defined by claim 14 further including roller glides secured to and rotatably mounted within each of said housings and positioned to rollingly contact a lateral edge of each of said guide members.

16. An organizing system as defined by claim 15 wherein each of said guide members further includes a stop member positioned on a lateral edge thereof adjacent the end opposite said knuckle portion, said stop members engageable with one of said roller glides to thereby limit extension of said housings with respect to said guide members.

17. An organizing system as defined by claim 16 further including a roller guide secured to a lateral edge of said guide member forward of said stop means, said roller guide rollingly engaging the inner peripheral surface of said housing.

18. An organizing system as defined by claim 14 wherein said housings each include a vertically extending lip portion and each of said modules includes an outwardly directed flange portion defining a longitudinally extending groove, said lip portion of said housing being slidably received within said groove thereby detachably supporting said module on said housing.

19. An organizing system as defined by claim 17 wherein said housings each include a vertically extending lip portion and each of said modules includes an outwardly directed flange portion defining a longitudinally extending groove, said lip portion of said housing being slidably received within said groove thereby detachably supporting said module on said housing.

20. An organizing system as defined by claim 19 wherein said housing further includes an upstanding, inwardly curved, longitudinally extending edge portion; said edge portion and said upstanding lip portion defining a storage module flange receiving channel, said curved portion frictionally engaging said flange when said module is supported by said housing.

21. An organizing system for use with a work surface, said system including a storage module adapted for movement between a storage position generally beneath and to the rear of said work surface thereby providing unrestricted knee clearance and permitting unobstructed lateral movement beneath the work surface and a retrieval position generally toward the front of said work surface providing easy access to said storage module, said system further comprising:

a vertical support plate;

an elongated member hingedly supported at one end thereof to said vertical support plate in a vertical plane generally beneath said work surface at a point spaced from the rear vertical plane of said work surface; and means received on said elongated member for supporting said storage module for extension and retraction on said elongated member.

22. An organizing system as defined by claim 21 further including:

hinge means for hingedly connecting said elongated member to the forward lateral edge of said vertical support plate so that said elongated member may pivot about a vertical axis through an angle of approximately 90°.

23. An organizing system as defined by claim 22 wherein supporting means comprises:

a generally channel-shaped member having a vertical planar portion and outwardly directed side portions integral with said planar portion, said side portions being vertically spaced so that said channelshaped member is telescopingly positionable on said elongated member.

24. An organizing system for use with a work surface, said system including a storage module adapted for movement between a storage position generally beneath and to the rear of said work surface thereby providing unrestricted knee clearance and permitting unobstructed lateral movement beneath the work surface and a retrieval position generally toward the front of said work surface providing easy access to said storage nodule, said system further comprising:

an elongated member hingedly supported generally beneath said work surface at a point spaced from the rear vertical plane of said work surfaces;

means receivable on said elongated member for supporting said storage module for extension and retraction on said elongated member;

a vertical support plate; and hinge means for hingedly connecting said elongated member to the forward lateral edge of said vertical support plate, said supporting means comprising a generally channel-shaped member having a vertical planar portion and outwardly directed side portions integral with said planar portion, said side portions being vertically spaced so that said channel-shaped member is telescopingly positionable on said elongated member, said supporting means further comprising an outer panel secured to said channel-shaped member along the longitudinal edges of said side portions thereby defining a housing telescopingly receivable on said elongated member.

25. An organizing system as defined by claim 24 wherein said supporting means further includes spaced roller glide means rotatably secured between said channel-shaped member and said outer panel, said roller glide means being spaced vertically and contacting the lateral edges of said elongated member.

26. An organizing system as defined by claim 25 further including a roller guide means secured to said elongated member adjacent the foreward end thereof on the upper lateral edge of said elongated member, said roller guide means contacting the inner peripheral surface of said side portions of said channel-shaped member.

27. An organizing system as defined by claim 26 wherein said channel-shaped member includes upper and lower vertical lip portions integral with said side portions, and said storage module includes a rear vertical wall and outwardly extending, grooved flanges said flanges being slidably receivable on said lip portions to thereby detachably receive and support said storage module.

28. An organizing system for use with a work surface, said system including a storage module adapted for movement between a storage position generally beneath and to the rear of said work surface thereby providing unrestricted knee clearance and permitting unobstructed lateral movement beneath the work surface and a retrieval position generally toward the front of said work surface providing easy access to said storage module, said system further comprising:

an elongated member hingedly supported generally beneath said work surface at a point spaced from the rear vertical plane of said work surface;

means receivable on said elongated member for supporting said storage module for extension and retraction on said elongated member;

a vertical support plate; and hinge means for hingedly connecting said elongated member to the forward lateral edge of said vertical support plate, said supporting means comprising a generally channel-shaped member having a vertical planar portion and outwardly directed side portions integral with said planar portion, said side portions being vertically spaced so that said channel-shaped member is telescopingly positionable on said elongated member, said channel-shaped member including upper and lower vertical lip portions integral with said side portions, and said storage module including a rear vertical wall and outwardly extending, grooved flanges, said flanges being slidably receivable on said lip portions to thereby detachably receive and support said storage module.

* * * * *